US005093613A

United States Patent [19]

Diepenmaat

[11] Patent Number: 5,093,613

[45] Date of Patent: Mar. 3, 1992

[54] TRANSFORMER

[75] Inventor: Hermanus B. M. Diepenmaat, Enschede, Netherlands

[73] Assignee: U.S. Philips Corporation, New York, N.Y.

[21] Appl. No.: 239,575

[22] Filed: Sep. 1, 1988

[30] Foreign Application Priority Data

Sep. 9, 1987 [NL] Netherlands ..... 8702133

[51] Int. Cl.[5] ..... H01F 27/40

[52] U.S. Cl. ..... 323/356; 323/359; 336/69

[58] Field of Search ..... 323/355, 356, 357, 358, 323/359; 336/69, 70, 84 R, 84 C, 180, 181

[56] References Cited

U.S. PATENT DOCUMENTS

| | | | |
|---|---|---|---|
| 1,702,771 | 2/1929 | Grozneveld | 336/182 |
| 3,210,706 | 10/1965 | Book | 336/69 |
| 3,299,384 | 1/1967 | Lee | 336/69 |
| 3,683,271 | 8/1972 | Kobayashi | 336/181 |
| 3,688,232 | 8/1972 | Szatmari | 336/69 |
| 3,886,434 | 5/1975 | Schreiner | 336/69 |
| 4,089,049 | 5/1978 | Suzuki et al. | 363/17 |
| 4,581,573 | 4/1986 | Dob a et al. | 323/356 |
| 4,639,663 | 1/1987 | Ueno et al. | 323/356 |

*Primary Examiner*—Peter S. Wong

*Attorney, Agent, or Firm*—Bernard Franzblau

[57] ABSTRACT

A transformer with interference suppression includes a primary winding (1) with a first primary coil (27), one end of which is connected to a primary reference point (19), and also includes a second primary coil (39). The transformer has a secondary winding (3) with a secondary coil (33), one end of which is conductively connected to a secondary reference point (21). All of said coils (27, 39, 33) are solenoid coils which are concentrically arranged on a coil former (5) with intermediate electrical insulating means (29, 31; 29, 37) so that the first primary coil (27), across which the voltage drop amounts to $U_{1p}$, is capacitively coupled to the secondary coil (33) across which the voltage drop amounts to $U_{1s}$. The capacitance between these two coils has the value $C_1$. The second primary coil (39), across which the voltage drop amounts to $U_{2p}$, is capacitively coupled to a secondary coil (33) across which the voltage drop amounts to $U_{2s}$. The capacitance between these two coils has the value $C_2$. In order to prevent a disturbing voltage from occurring between the primary reference point (19) and the secondary reference point (21), the following condition is satisfied:

$$C_1(U_{1s}-U_{1p})=C_2(U_{2p}-U_{2s}).$$

11 Claims, 3 Drawing Sheets

TRANSFORMER

BACKGROUND OF THE INVENTION

This invention relates to a transformer, comprising, a primary winding and a secondary winding, the primary winding comprising at least one first primary coil which is wound in the form of a solenoid and an end of which is conductively connected to a primary reference point, the secondary winding comprising at least one secondary coil which is wound in the form of a solenoid and an end of which is conductively connected to a secondary reference point, which coils are concentrically arranged on a coil former with intermediate electrical insulating means.

A transformer of this kind is known, for example, from U.S. Pat. No. 4,089,049. It is described therein that a disturbing voltage occurs between the primary and the secondary reference point of such a transformer. This disturbing voltage is caused by the voltage across the windings and the parasitic capacitance between the windings. In the known transformer the disturbing voltage is suppressed by mounting electrostatic shields between the primary and secondary windings. This method provides the desired result, but also has a number of drawbacks. The mounting of the shields increases the dimensions and the weight of the transformer and reduces the coupling factor between the windings. Eddy currents are liable to occur in the shields, so that the transformer losses increase. The presence of the shields makes it difficult to satisfy some severe requirements imposed as regards the electrical insulation between the primary and secondary sides of the transformer.

SUMMARY OF THE INVENTION

It is an object of the invention to provide a transformer of the kind set forth in which the suppression of the disturbing voltage between the primary and the secondary reference point is realized without using electrostatic shields between the primary and secondary windings.

To achieve this, the transformer in accordance with the invention is characterized in that the primary winding further comprises a second primary coil which is also wound in the form of a solenoid and which is mounted with intermediate electrical insulating means on the coil former so as to be concentric with the other coils, and in that:

a) the first primary coil, across which the voltage drop amounts to $U_{1p}$ in the operating condition, is capacitively coupled, via one of the electrical insulating means, to a secondary coil across which the voltage drop amounts to $U_{1s}$ in the operating condition, the capacitance between these two coils amounting to $C_1$.

b) the second primary coil, across which the voltage drop amounts to $U_{2p}$ in the operating condition, is capacitively coupled, via one of the electrical insulating means, to a secondary coil across which the voltage drop amounts to $U_{2s}$ in the operating condition, the capacitance between these two coils amounting to $C_2$;

c) the following condition is satisfied $$C_1(U_{1s}-U_{1p})=C_2(U_{2p}-U_{2s}).$$

In the transformer in accordance with the invention the disturbing voltage between the primary and the secondary reference point is suppressed by a suitable choice of the number of turns of the coils and the winding sense of these coils and also of the properties of the insulation means which determine the capacitance between neighbouring primary and secondary coils. The dimensions and the weight of the transformer can thus be kept small and no electrostatic shields are required in which eddy currents can occur and which could have an adverse effect on the insulation between the primary and the secondary side.

For the determination of the sign of the voltages it is important that all primary voltages are assumed to have been measured with respect to the primary reference point and all secondary voltages to have been measured with respect to the secondary reference point. Hereinafter, numbers of turns (being the numbers indicating the number of turns of a coil) will be provided with opposite signs when the ends of the relevant coils which are remote from the reference point carry opposed voltages in the operating condition with respect to the ends of the relevant coils which are connected to the reference point.

In addition to said coils which are capacitively coupled via the intermediate insulation means and which contribute to the suppression of the disturbing voltage, the primary as well as the secondary winding may also comprise further coils, the insulation means between each of these further coils and the other coils having properties such that the further coils are not or substantially not capacitively coupled to the other coils.

An embodiment of the transformer in accordance with the invention, which can be particularly simply wound, is characterized in that the secondary winding comprises a single secondary coil comprising w turns, the first primary coil comprising nw turns and the second primary coil comprising -pw turns, the condition being satisfied because $$C_1(n-1)=C_2(p+1).$$

In this embodiment, only two primary and one secondary coil are required for suppressing the disturbing voltage.

A further embodiment of the transformer in accordance with the invention is characterized in that a) the secondary winding comprises two coils, each of which consists of a bifilar pair of sub-coils wound in the form of a solenoid, one end of the first sub-coil being conductively connected to the opposite end of the second sub-coil so that in operation the non-interconnected ends of the two sub-coils carry the same voltages but with opposed polarity with respect to the interconnected ends of the sub-coils;

b) the first primary coil is capacitively coupled to the first secondary coil and the second primary coil is capacitively coupled to the second secondary coil;

c) the numbers of turns of the first and the second primary coil relate as q/r, the condition being satisfied because $$C_1r=C_2q.$$

As usual, "bifilar wound coils" are to be understood, to mean coils which are formed by winding two wires together, so that there are obtained two coils having the same number of turns which are wound in the same direction and which are uniformly distributed across the same winding space.

BRIEF DESCRIPTION OF THE DRAWINGS

The invention will be described in detail hereinafter with reference to the accompanying drawing, in which.

DESCRIPTION OF THE PREFERRED EMBODIMENTS

Figure 1A:
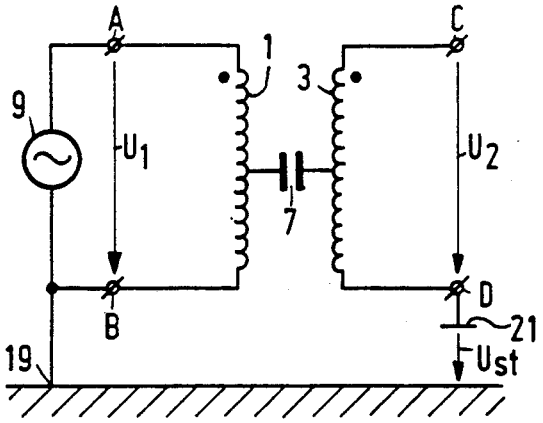
FIG. 1*a* shows a diagram of a transformer with a parasitic capacitance between the primary and secondary windings, which cause a disturbing voltage, FIG. 1*b* diagrammatically shows a part of a coil former of the transformer shown in FIG. 1*a* with the primary and secondary windings.
Figure 1B:
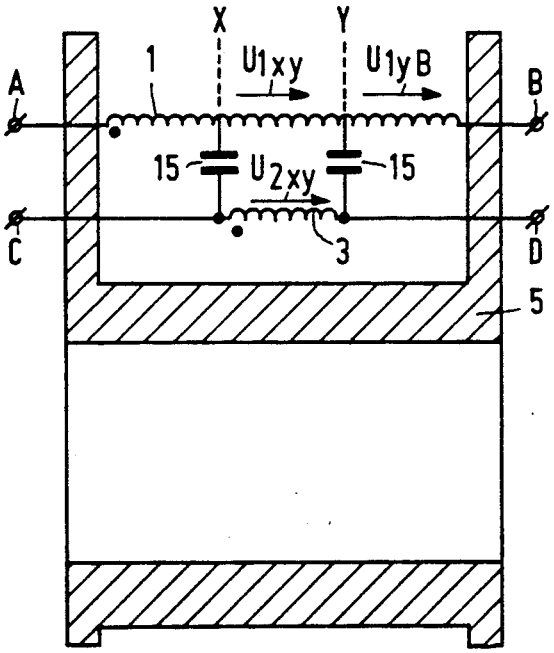

FIG. 1*a* shows a transformer which comprises a primary winding 1 and a secondary winding 3. The primary winding 1 is connected to terminals A and B and the secondary winding 3 is connected to terminals C and D. As is diagrammatically shown in FIG. 1*b*, the windings 1, 3 comprise coils which are wound in the form of solenoids and which are concentrically arranged on a coil former 5 of an electrically insulating material. Between the mutually concentric coils there are provided electrical insulation means (not shown in the Figure). The primary winding 1 and the secondary winding 3 are capacitively coupled by a parasitic capacitance which occurs between the concentric coils and which is represented by a capacitor 7 in FIG. 1*a*. The value $C_p$ of this parasitic capacitance depends on the properties of the insulating means present between the primary and secondary coils, for example, the thickness and the dielectric constant of the insulation material, and on the length of the directly successive primary and secondary coils. In the embodiment shown, each winding 1, 3 consists of a single coil which is wound as a solenoid, the length of the primary coil being greater than that of the secondary coil. As a result, the parasitic capacitance $C_p$ is present mainly in a limited region whose boundaries are denoted by the references X and Y in FIG. 1*b*.

When the primary winding 1 is connected, via the terminals A and B, to an external voltage source 9 of the magnitude $U_1$, a voltage $U_2$ arises across the secondary winding. The polarity of $U_2$ with respect to $U_1$ depends on the winding sense of the primary and secondary windings. In the present embodiment, this winding sense is the same, as denoted in a conventional manner by means of a dot near one end of the windings. The polarity of $U_1$ and $U_2$ is then also the same as denoted by the arrows given for these voltages.

Between X and Y there are situated two voltage sources which are formed by the number of turns present between X and Y, multiplied by the voltage per turn. The magnitude of these voltage sources, being denoted by the reference numerals 11 and 13 in the equivalent diagram of FIG. 2*a*, amounts to $U_{1XY}$ and $U_{2XY}$, respectively. Because the parasitic capacitance $C_p$ is homogeneously distributed across the region X–Y, it can be represented by two capacitors 15, each of which has a value $\frac{1}{2}$ $C_p$ and interconnects the points X and C and the points Y and D, respectively. Between Y and B there is situated a third voltage source of the magnitude $U_{1YB}$ which is denoted by the reference numeral 17 in FIG. 2*a*.

Figure 2A:
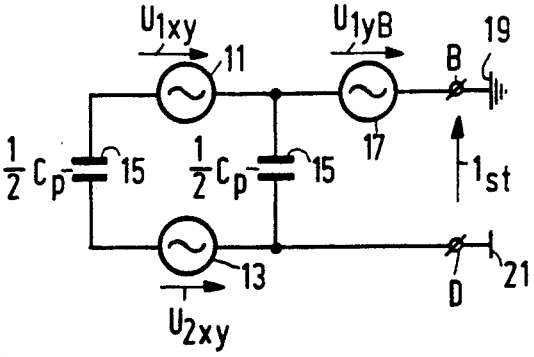
FIGS. 2*a* and 2*b* show equivalent diagrams relating to the transformer shown in the FIGS. 1*a* and 1*b*.
Figure 2B:
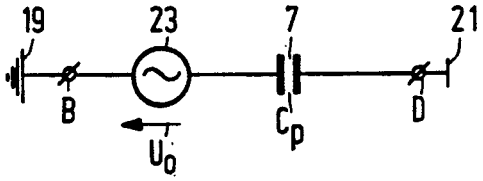

As appears from FIG. 2*a*, when one end of the primary winding 1 is connected to a primary reference point 19 and one end of the secondary winding 3 is connected to a secondary reference point 21, a disturbing voltage $U_{st}$ arises between the primary reference point and the secondary reference point due to the voltage sources 13, 11, 17 and the parasitic capacitance $C_p$. Using Thevenin's theorem, the disturbance equivalent diagram shown in FIG. 2*a* can be simplified so as to form the diagram shown in FIG. 2*b* which comprises a single disturbing voltage source 23 of the magnitude $U_0=U_{1YB}+\frac{1}{2}(U_{1XY}-U_{2XY})$ in series with a capacitor 7 having the value $C_p$. FIG. 2*b* corresponds to FIG. 2*b* of U.S. Pat. No. 4,089,049.

Figure 3:
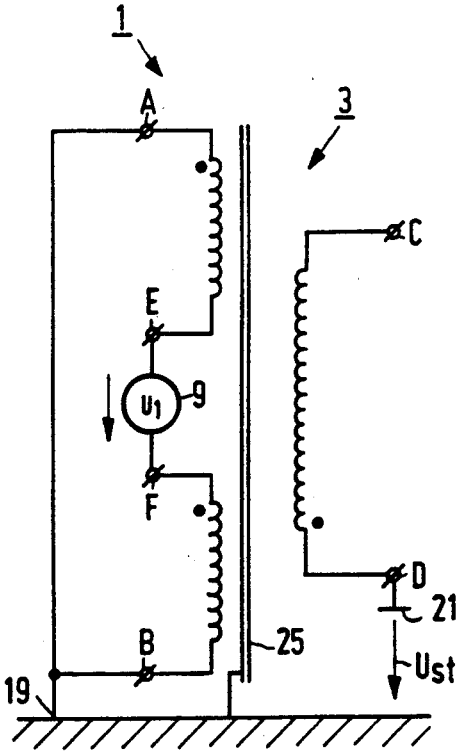
FIG. 3 shows a diagram of a first embodiment of a transformer in accordance with the invention, FIGS. 4*a* and 4*b* diagrammatically show the construction of the transformer shown in FIG. 3, FIGS. 5*a* and 5*b* show equivalent diagrams relating to the transformer shown in FIG. 3.

It has been found that it can be demonstrated that the occurrence of the disturbing voltage $U_{st}$ can be prevented by winding the transformer so that $U_0=0$. FIG. 3 shows a diagram of a first embodiment of a transformer having this property. In FIG. 3 and the subsequent Figures, corresponding elements are denoted by the same reference numerals as are used in the FIGS. 1*a*, *b* and the FIGS. 2*a*, *b*. In the embodiment shown in FIG. 3, the primary winding 1 is subdivided into two sub-windings, the ends of the first sub-winding being connected to the terminals A and E and those of the second sub-winding to the terminals F and B. The terminals E and F are also connected to the external voltage source 9 of the magnitude $U_1$ and the terminals A and B are connected to one another and to the primary reference point 19. The core 25 of the transformer is also connected to the primary reference point 19. The ends of the secondary winding 3 are again connected to the terminals C and D, the terminal D being connected to the secondary reference point 21.

Figure 4A:
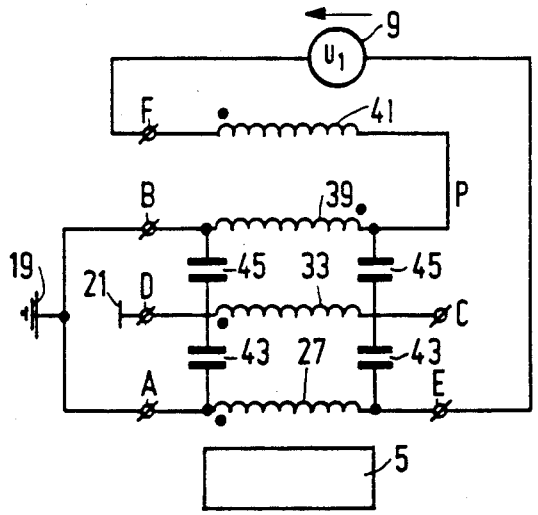
Figure 4B:
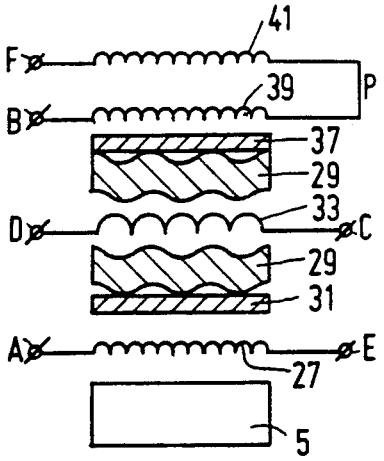

As appears from the FIGS. 4*a* and 4*b*, the part of the primary winding 1 which is situated between the terminals A and E consists of a first primary coil 27 which is wound as a solenoid and which is arranged on the coil former 5. On the coil 27 there is wound a secondary coil 33 in the form of a solenoid which forms the secondary winding 3 and whose ends are connected to the terminals C and D. The coil 33 is electrically insulated from the coil 27 by first electrical insulating means 29, 31. To this end, the coil 33 may be wound, for example, from an electrically conductive wire insulated with a comparatively thick layer 29 of PTFE (thickness, for example, 0.4 mm, dielectric constant 2). Between the coils 27 and 33 there may be provided a comparatively thin layer of polycarbonate foil 31 which serves to smooth the corrugated surface of the coil 27, consisting of adjoining turns, and which has no substantial effect on the dielectric properties of the layer.

The coil 33 is surrounded by the part of the primary winding 1 which is situated between the terminals B and F and which is composed of a second primary coil 39 between the terminal B and a point P and a series connected third primary coil 41 between the point P and the terminal F. These coils are also wound in the form of a solenoid and are concentric with the coils 27 and 33. Between the coils 33 and 39 there are provided second electrical insulating means 29, 37 which consist of the combination of said PTFE insulation jacket 29 and a second layer of polycarbonate foil 37 in order to obtain a smooth surface on which the coil 39 can be wound. Evidently, the first and the second insulating means can alternatively be composed of one or more layers of foils, having the desired thickness and dielectric properties, which are provided between the coils 27 and 33, and 33 and 39, respectively.

If desirable, an electrically insulating layer (not shown in FIG. 4*b*) also can be provided between the coils 39 and 41, the properties of said layer being chosen so that the third primary coil 41 is not capacitively coupled to the secondary coil 33. The winding sense of the coils is denoted in the conventional manner by means of dots in FIG. 4*a*. The number of turns of the secondary coil 33 is w, that of the first primary coil 27 is nw, that of the second primary coil 39 is −pw, and that of the third primary coil 41 is (n−p) w. The minus sign preceding the number of turns of the second primary coil 39 indicates that the winding sense of this coil is much that the polarity of the voltage at its end which is not connected to the reference point opposes the polarity of the voltage at the corresponding end of the secondary coil 33. The properties of the insulating layers 29, 31, 37 are chosen so that the capacitance between the first primary coil 27 and the secondary coil 33 has the value $C_1$ and that between the secondary coil and the second primary coil 39 has the value $C_2$. As in FIG. 1*b*, these capacitances can be represented each time by two capacitors having half the capacitance. To this end, in FIG. 4*a* two capacitors 43 having a capacitance $\frac{1}{2}$ $C_1$ are shown between the coils 27 and 33 and two capacitors 45 having a capacitance $\frac{1}{2}$ $C_2$ are shown between the coils 33 and 39.

Figure 5A:
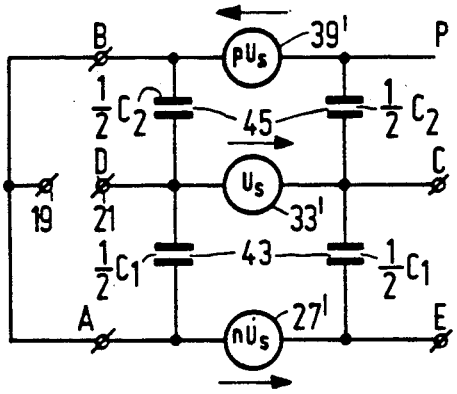

When it is assumed that the voltage source 9 of the magnitude $U_1$ which is present between the terminals E and F causes a voltage drop $U_s$ across the secondary coil 33 comprising w turns, the voltage drop across the coil 27 will be $nU_s$ and that across the coil 39 will be $pU_s$. The coils 27, 33, 39 can again be considered to be voltage sources which cause, together with the capacitors 43, 45, a disturbing voltage $U_{st}$ between the primary reference point 19 and the secondary reference point 21. The associated equivalent diagram is shown in FIG. 5*a*. Therein, the voltage sources are denoted by the same reference numerals as the coils they represent, be it that they are provided with an accent. The polarity of the voltages is again indicated by means of arrows.

Figure 5B:
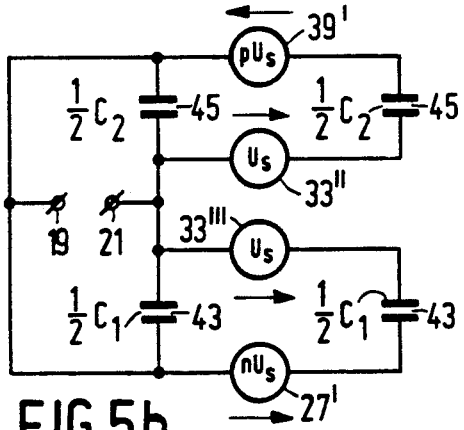
Figure 6:
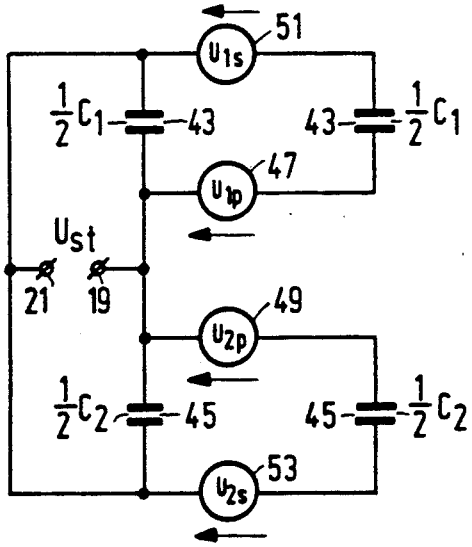
FIG. 6 shows a general equivalent diagram relating to a transformer in accordance with the invention.

It will be apparent that the voltage source 33' may be divided into two separate, parallel-connected sources 33'' and 33'''. each having the magnitude $U_s$. This results in the equivalent diagram shown in FIG. 5*b*. This equivalent diagram corresponds to the general equivalent diagram shown in FIG. 6 which includes two primary voltage sources 47 and 49 whose voltages are $U_{1p}$ and $U_{2p}$, respectively, and two secondary voltage sources 51 and 53 whose values are $U_{1s}$ and $U_{2s}$, respectively. The equivalent diagram of FIG. 6 is equal to that of FIG. 5*b* when the following values are chosen for the voltage sources 47, 49, 51, 53 occurring therein:

$$U_{1s}=-U_s;\ U_{1p}=-nU_s;\ U_{2p}=pU_s;\ U_{2s}=-U_s \qquad (1).$$

It will be apparent that the voltage $U_{st}$ between the primary and secondary reference points 19 and 21 equals zero when the following condition is satisfied:

$$Z_2(U_{1s}-U_{1p})=Z_1(U_{2p}-U_{2s}) \qquad (2).$$

Therein, $Z_1$ and $Z_2$ are the impedances of the capacitors $C_1$ and $C_2$, so that $$Z_1 = jw^1c_2 \text{ and } Z_2 = \frac{1}{jw\,C_2}.$$

The relation (2) can thus also be written as:

$$C_1(U_{1s}-U_{1p})=C_2(U_{2p}-U_{2s}) \qquad (3).$$

Each transformer for which a disturbance equivalent diagram as shown in FIG. 6 holds good, therefore, has a disturbing voltage $U_{st}$ which is equal to zero between the primary and the secondary reference points if the condition (3) is satisfied. When this condition is applied, using (1), to the transformer which is shown in FIG. 3 and which has the disturbance equivalent diagram shown in FIG. 5*b*, the following is found:

$$C_1(nU_s-U_s)=C_2(pU_s+U_s) \qquad (4)$$

or:

$$C_1(n-1)=C_2(p+1) \qquad (5).$$

When the properties of the insulating layers 29, 31 and 37 in a transformer as shown in the FIGS. 3, 4*a* and 4*b* are chosen so that $C_1=C_2$, the number of turns of the coils must be chosen so that n−p=2. In a practical embodiment, the coils 27, 33, 39 and 41 comprised 40, 10, 20 and 20 turns, respectively, so that n=4 and p=2. The insulating layers 31 and 37, in this case both consisted of a thin layer of polycarbonate and the insulating means 29 consisted of an insulating jacket having a thickness of 0.4 mm around the winding wire of the coil 33.

Figure 7:
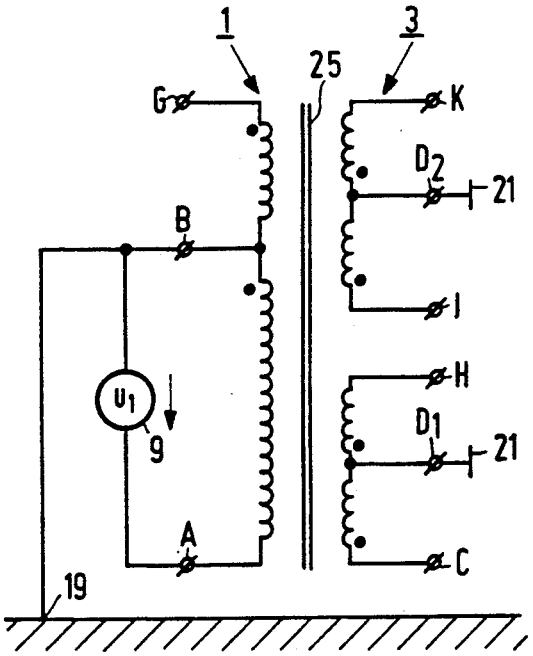
FIG. 7 shows a diagram of a second embodiment of a transformer in accordance with the invention, FIG. 8 diagrammatically shows the construction of the transformer shown in FIG. 7, and FIGS. 9*a* and 9*b* show equivalent diagrams relating to the transformer shown in FIG. 7.
Figure 8:
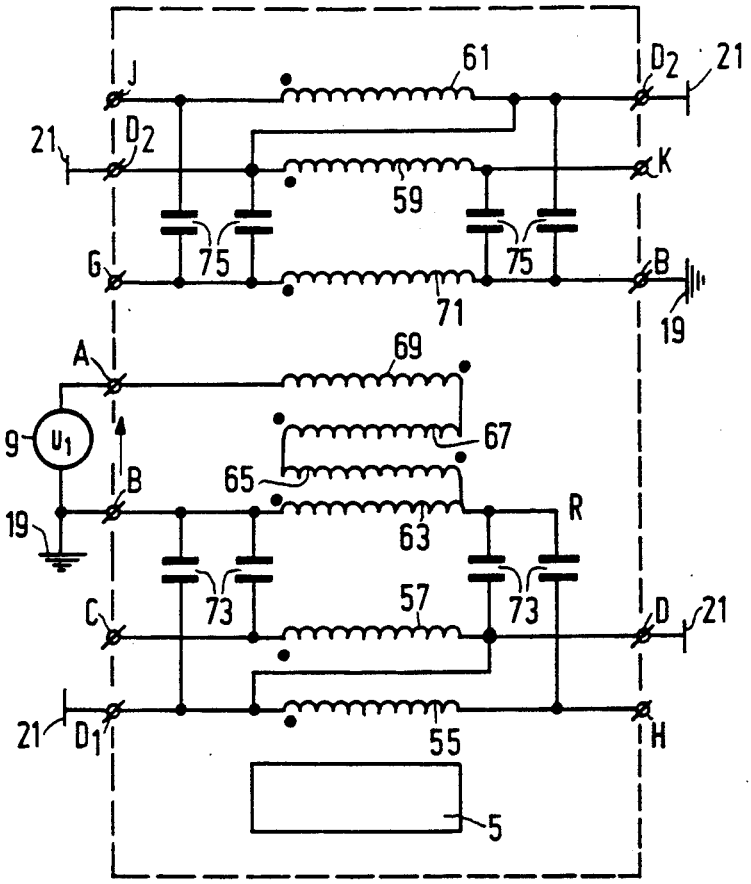

FIGS. 7 and 8 show an embodiment in which the primary winding 1 consists of a first part which is connected to the terminals A and B and which comprises four concentric primary coils which are wound in the form of a solenoid, and a second part which is connected to the terminals B and G and which comprises one primary coil wound in the form of a solenoid. The external voltage source 9 is connected between the terminals A and B. The secondary winding 3 consists of a first part which is connected to the terminals C, $D_1$ and H and a second part which is connected to the terminals J, $D_2$ and K. Each of the two parts of the secondary winding 3 consists of a secondary coil which is composed of a bifilar pair of sub-coils wound in the form of a solenoid. During the bifilar winding, two insulated wires are simultaneously wound adjacently so that two coils having the same number of turns, wound in the same direction, are formed within one and the same winding space. The sub-coils of the first secondary coil are denoted by the reference numerals 55 and 57 in FIG. 8 and those of the second secondary coil by the reference numerals 59 and 61. A first end of the first sub-coil 55 of the first secondary coil, denoted by a dot, is conductively connected to the terminal $D_1$ and to the opposite end of the second sub-coil 57 which is not provided with a dot. In operation, the non-interconnected ends of these two sub-coils, being connected to the terminals H and C, respectively, thus carry equal voltages with opposed polarity with respect to the ends which are connected to one another and to the terminal $D_1$. Analogously, a first end of the first sub-coil 59 of the second secondary coil is conductively connected to the terminal $D_2$ and to the opposite end of the second sub-coil 61. In operation, the non-interconnected ends of these two subcoils, being connected to the terminals K and J, respectively, thus also carry equal voltages with opposed polarity with respect to the ends which are connected to one another and to the terminal $D_2$. The terminals $D_1$ and $D_2$ are also connected to the secondary reference point 21 and the terminal B is connected to the primary reference point 19.

The first secondary coil 55, 57 is arranged on the coil former 5. This coil is surrounded by first electrical insulating means (not shown) which may be constructed, for example, in the same way as the layers 29, 31 and 37 described with reference to FIG. 4*b*. Over these insulating means there is wound the first primary coil 63 which is concentrically surrounded by three successive further primary coils 65, 67 and 69. On these coils there are provided second electrical insulating means (not shown) on which the second primary coil 71 is wound so as to be concentric with the preceding coils, which second primary coil is surrounded by electrical insulating means (not shown) which are comparable to the layers 29, 31, 37 and on which the second secondary coil 59, 61 is wound. The winding sense of the coils is denoted by dots in the conventional manner in FIG. 8. The properties of the insulating means are chosen so that the capacitance between the first primary coil 63 and each of the two sub-coils of the first secondary coil 55, 57 amounts to $\frac{1}{2}$ $C_1$, and that between the second primary coil 71 and each of the two sub-coils of the second secondary coil 59, 61 amounts to $\frac{1}{2}$ $C_2$. In FIG. 8 these capacitances are again represented by two capacitors having half the capacitance. Thus, between the first primary coil 63 and the first secondary coil 55, 57 there are provided four capacitors 73 having a capacitance $\frac{1}{4}$ $C_1$, and between the second primary coil 71 and the second secondary coil 59, 61 there are provided four capacitors 75 having a capacitance $\frac{1}{4}$ $C_2$. No capacitance which could be of significance for the appearance of disturbing voltages is present between the other coil pairs.

For the determination of the disturbing voltage $U_{st}$ between the primary and secondary reference points 19 and 21, again only the capacitively coupled primary and secondary coils are of importance. Because the first secondary coil 55, 57 is composed of two series connected sub-coils 55 and 57 which carry opposed voltages, this coil acts as a voltage source for a voltage of 0 V. The same is applicable to the second secondary coil 59, 61. When the voltage per turn is assumed to be equal to $U_w$ and when the number of turns of the first primary coil 63 equals q and that of the second primary coil 71 equals $-r$, the first and the second primary coil may be considered to be voltage sources of the magnitude $q\,U_w$ and $-rU_w$, respectively. The minus sign preceding r indicates that the second primary coil 71 is wound so that the polarity of the voltage at its end which is not connected to the primary reference point 19 opposes the polarity of the voltage at the corresponding end of the first primary coil 63.

Figure 9A:
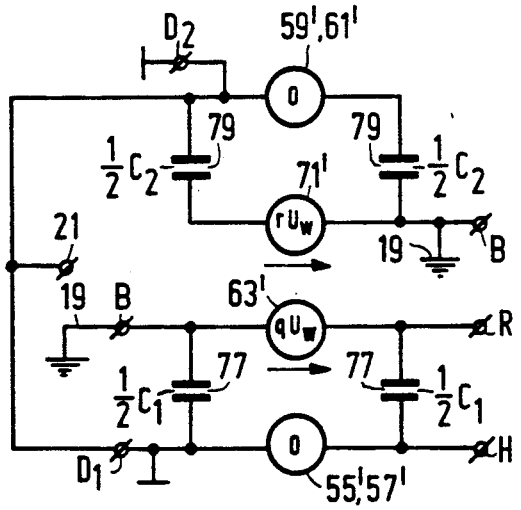

On the basis of the foregoing, the disturbance equivalent diagram shown in FIG. 9*a* holds good for the transformer shown in FIGS. 7 and 8. The voltage sources in the disturbance equivalent diagram are again denoted by the reference numerals of the coils they represent, said reference numerals being provided with an accent. The four capacitors 73 are again connected in parallel in a two-by-two arrangement so that in FIG. 9*a* they are replaced by two capacitors 77, each of which has a capacitance $\frac{1}{2}$ $C_1$. Analogously, the four capacitors 75 are replaced in FIG. 9*a* by two capacitors 79, each of which has a capacitance $\frac{1}{2}$ $C_2$.

Figure 9B:
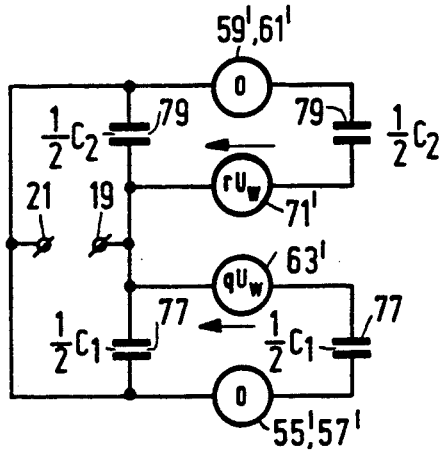

When the disturbance equivalent diagram shown in FIG. 9*a* is slightly modified, the diagram shown in FIG. 9*b* is obtained. A comparison with FIG. 6 reveals that both diagrams are equal when the following values are chosen for the voltage sources occurring in FIG. 6:

$$U_{1s}=0;\ U_{1p}=rU_w;\ U_{2p}=-q\,U_w;\ U_{2s}=0 \qquad (6).$$

By applying (3), the following condition is found for $U_{st}=0$:

$$C_1r=C_2q \qquad (7).$$

When the properties of the insulating means are chosen so that $C_1=C_2$, the numbers of turns of the primary coils must be chosen so that $r=q$. In a practical embodiment, each of the coils 55 and 57 comprised 10 turns, each of the coils 63, 65, 67, 69 and 71 comprised 17 turns, and each of the coils 59 and 61 comprised 34 turns. The insulating means were the same as those used in the first embodiment.

It appears from the described embodiments that only the capacitively coupled primary and secondary coils are of importance for the appearance of the disturbing voltage $U_{st}$ between the primary and secondary reference points 19 and 21. The primary and secondary windings 1 and 3, may also comprise coils which are not capacitively coupled to the other winding and which exclusively serve to ensure that the transformer satisfies the other requirements imposed, for example, as regards the value of the voltages and currents to be supplied. Coils of this kind are, for example, the coil 41 in the first embodiment and the coils 65, 67 and 69 in the second embodiment. In order to suppress the disturbing voltage, the secondary coils in the second embodiment must be composed of two bifilar wound, oppositely connected sub-coils, but the total number of turns of each secondary coil can be chosen at random in order to satisfy other requirements.

What is claimed is:

1. A transformer comprising: a primary winding and a secondary winding, the primary winding comprising at least one first primary coil which is wound in the form of a solenoid and having an end conductively connected to a primary reference point, the secondary winding comprising at least one secondary coil which is wound in the form of a solenoid and having an end conductively connected to a secondary reference point, which coils are concentrically arranged on a coil former with an intermediate electrical insulating means, characterized in that the primary winding further comprises a second primary coil which is also wound in the form of a solenoid and which is mounted, with intermediate electrical insulating means on the coil former so as to be concentric with the other coils, and in that:

a) the first primary coil, which in operation develops a voltage drop of $U_{1p}$, is capacitively coupled, via one of the electrical insulating means, to a secondary coil which develops a voltage drop of $U_{1s}$ in operation, a capacitance $C_1$ being present between said first primary coil and the secondary coil;

b) the second primary coil, which in operation develops a voltage drop of $U_{2p}$, is capacitively coupled, via one of the electrical insulating means, to a secondary coil across which, in operation, a voltage drop of $U_{2s}$ occurs, a capacitance between the second primary coil and the secondary coil being equal to $C_2$;

c) the following condition is satisfied:

$$C_1(U_{1s}-U_{1p})=C_2(U_{2p}-U_{2s}).$$

2. A transformer as claimed in claim 1, characterized in that the secondary winding comprises a single secondary coil comprising w turns, the first primary coil comprising nw turns and the second primary coil comprising $-$pw turns, the condition being satisfied because $C_1(n-1)=C_2\ (p+1)$, wherein n and p are numbers indicating a turns ratio of the first primary coil and the second primary coil, respectively, relative to the secondary coil.

3. A transformer as claimed in claim 2, characterized in that $C_1=C_2$ and $n-p=2$.

4. A transformer as claimed in claim 1, characterized in that a) the secondary winding comprises first and second secondary coils, each of which comprises a bifilar pair of first and second sub-coils wound in the form of a solenoid, one end of the first sub-coil being conductively connected to an opposite end of the second sub-coil to form interconnected ends so that in operation non-interconnected ends of the first and second sub-coils carry the same voltage and with opposed polarity with respect to the interconnected ends:

b) the first primary coil is capacitively coupled to the first secondary coil and the second primary coil is capacitively coupled to the second secondary coil;

c) the number of turns of the first and the second primary coil are q and r, respectively, and relate as q/r, the condition being satisfied because $C_1r=C_2q$.

5. A transformer as claimed in claim 4, characterized in that $C_1=C_2$ and $q=r$.

6. A transformer as claimed in claim 1 wherein the secondary winding comprises a single secondary coil comprising w turns, the first primary coil comprises nw turns and the second primary coil comprises pw turns, wherein n and p are numbers indicating a turns ratio of the first primary coil and the second primary coil, respectively, relative to the secondary coil, and $C_1\ (n-1)=C_2\ (p+1)$.

7. A low interference transformer comprising:

a primary winding including first and second primary coils with one end of the first primary coil electrically connected to a primary reference point, a secondary winding including at least one secondary coil having one end electrically connected to a secondary reference point, said secondary coil and said first primary coil being concentrically arranged on a coil former and with first electrical insulating means between said coils to form a capacitance $C_1$ therebetween, said second primary coil being arranged on the coil former concentric with the first primary coil and secondary coil and with second insulating means between the second primary coil and secondary coil to form a capacitance $C_2$ therebetween, and wherein, in operation, voltage drops of $U_{1p}$, $U_{1s}$, $U_{2p}$ and $U_{2s}$ are developed across the first primary coil, a secondary coil, the second primary coil and a secondary coil, respectively, and the voltage at the primary reference point and the secondary reference point are equal if: $C_1\ (U_{1s}-U_{1p})=C_2\ (U_{2p}-U_{2s})$.

8. A transformer as claimed in claim 7 wherein the secondary winding comprises a single secondary coil and the first primary coil, the secondary coil and the second primary coil are arranged concentrically about the coil former in the order named and with said first electrical insulating means between the first primary coil and the secondary coil and the second electrical insulating means between the secondary coil and the second primary coil.

9. A transformer as claimed in claim 7 wherein the first primary coil and the second primary coil each have a first end connected to the primary reference point and each have a second end connected to a respective terminal of a source of voltage, said first primary coil and said second primary coil being wound so that in operation said first ends thereof are of opposite polarity.

10. A transformer as claimed in claim 7 wherein, the secondary winding comprises first and second secondary coils, each of which comprises a bifilar winding of first and second sub-coils, the first primary coil is capacitively coupled to the first secondary coil and the second primary coil is capacitively coupled to the second secondary coil, and the first and second primary coils have q turns and r turns, respectively, and $C_1r=C_2q$.

11. A low interference transformer comprising:

a primary winding including first and second primary coils with one end of the first primary coil electrically connected to a primary reference point, a secondary winding including at least one secondary coil having one end electrically connected to a secondary reference point, said second secondary coil and said first and second primary coils being concentrically arranged on a coil former and with first electrical insulating means between said first primary coil and secondary coil to form a capacitance $C_1$ therebetween and second electrical insulating means between said second primary coil and secondary coil to form a capacitance $C_2$ therebetween, and wherein, the first and second insulating means and the turns ratio of the first and second primary coils and the secondary coil and the winding sense of said coils are chosen so that the voltage at the primary reference point and the voltage at the secondary reference point are equal.

* * * * *